US005927101A

United States Patent [19]

Oh

[11] Patent Number: 5,927,101

[45] Date of Patent: Jul. 27, 1999

[54] AIR CONDITIONER HAVING A LOW-RESISTANCE OIL SEPARATION UNIT

[75] Inventor: Sung-je Oh, Kyungki-do, Rep. of Korea

[73] Assignee: Samsung Electronics Co., Ltd., Suwon-City, Rep. of Korea

[21] Appl. No.: 09/096,174

[22] Filed: Jun. 12, 1998

[30] Foreign Application Priority Data

Feb. 12, 1998 [KR] Rep. of Korea ..... 98-4119

[51] Int. Cl.[6] ..... F25B 43/02

[52] U.S. Cl. ..... 62/468; 62/470

[58] Field of Search ..... 62/84, 468, 470, 62/473, 192

[56] References Cited

U.S. PATENT DOCUMENTS 4,862,699 9/1989 Lounis ..... 62/84

4,912,937 4/1990 Nakamura et al. ..... 62/160

5,199,271 4/1993 Ewer ..... 62/84

5,636,520 6/1997 Spauschus et al. ..... 62/84

*Primary Examiner*—William Doerrler

*Attorney, Agent, or Firm*—Burns, Doane, Swecker & Mathis, L.L.P.

[57] ABSTRACT

An air conditioner includes a compressor for compressing a refrigerant, and a condenser for condensing the refrigerant. A capillary tube lowers the pressure of the refrigerant, and an evaporator evaporates the low-pressure refrigerant. An oil separation unit is disposed between the compressor and the condenser for separating oil contained in the refrigerant. A bypass pipe is disposed in parallel with the oil separation unit and directly conveys some of the refrigerant from the compressor into the condenser, thereby reducing flow resistance in the oil separation unit and reducing power consumption.

4 Claims, 2 Drawing Sheets

AIR CONDITIONER HAVING A LOW-RESISTANCE OIL SEPARATION UNIT

BACKGROUND OF THE INVENTION

1. Field of the Invention

The present invention relates to an air conditioner having an oil separator for separating oil from refrigerant downstream of a compressor.

2. Description of the Prior Art

Generally, an air conditioner is an apparatus for maintaining an inside air in an optimum condition. Such air conditioner functions to adjust the inside air to temperature, humidity, and wind current suitable to human activities, and simultaneously to remove foreign matters such as dust entrained in the inside air. Among these functions, the primary one of the air conditioner is to maintain the inside temperature in an optimum condition.

A conventional air conditioner, as shown in FIG. 3, includes a compressor 1, a condenser 2, a capillary tube 3, and an evaporator 4. And the air conditioner adjusts inside temperature by means of refrigerant which is repeatedly circulated through the cycle of compressor 1, condenser 2, capillary tube 3, and the evaporator.

The refrigerant cycle operates roughly as follows.

First, a refrigerant is compressed in compressor 1 to a high temperature and high pressure gaseous phase, and introduced into condenser 2. In condenser 2, the gaseous refrigerant is changed into a normal temperature and high pressure liquefied refrigerant as it is heat exchanged with the periphery atmosphere or cooling water. High pressure liquified refrigerant in condenser 2 now loses its pressure and becomes chilled when it passes through capillary tube 3; the refrigerant becomes a low pressure liquid which is apt to be evaporated. So, when the cold low pressure refrigerant passes through evaporator 4, it is evaporated while absorbing surrounding heat. The evaporated refrigerant, that is, gaseous refrigerant flows into compressor 1, and the whole process is repeated.

For a better understanding, reference numerals 5 and 6 in the drawings respectively indicate a propeller and a blowing fan for expanding heat exchanging efficiency. And reference numeral la indicates an accumulator disposed upstream of the compressor for blocking a flow of refrigerant which is not completely gasified, that is, a refrigerant partly in liquid phase, into compressor 1. Finally, reference numeral 9 indicates a refrigerant conveying pipe for conveying refrigerant into the corresponding devices.

Meanwhile, oil is mixed with the refrigerant for lubricating and cooling compressor 1 in the air conditioner, and thus oil and refrigerant flow together inside compressor 1. Accordingly, some oil is exhausted along with refrigerant during exhaustion of high pressure refrigerant, and continuously circulated through condenser 2, capillary tube 3, and evaporator 4.

As the amount of oil circulated with the refrigerant increases, the amount of refrigerant gets smaller, and the performance of the air conditioner deteriorates. When the exhausted oil is not returned to compressor 1, or when the return time becomes late, a shortage of oil occurs in compressor 1, causing the trouble with the compressor operation.

As a solution, as shown in FIG. 4, an oil separation unit provided between compressor 1 and condenser 2 has been suggested. The oil separation unit separates oil from the exhausted refrigerant and returns it to compressor 1, thereby ensuring that the compressor is always properly lubricated.

However, oil separation unit 7 creates a large amount of flow resistance during the separation process. That is, as shown in FIG. 2, an air conditioner provided with oil separation unit 7 may provide improved performance as compared to a conventional air conditioner which has no oil separation unit, but the provision of an oil separator increases the consumption of electric power and thereby diminishes economic efficiency.

SUMMARY OF THE INVENTION

The object of the present invention is to provide an air conditioner capable of reducing the flow resistance occurring during the separation of oil from the refrigerant, thereby improving performance and efficiency.

To achieve the above object, an air conditioner according to the present invention comprises a compressor for compressing a refrigerant into a high temperature and high pressure gaseous refrigerant, and a condenser for condensing the compressed gaseous refrigerant into a lower temperature and high pressure liquid refrigerant. A capillary tube lowers the pressure of the refrigerant introduced from the condenser, and an evaporator evaporates the refrigerant passed through the capillary tube to cool ambient air. An oil separation unit is disposed between the compressor and the condenser for separating oil contained in refrigerant discharged from the compressor. A bypass pipe is disposed in parallel with the oil separation unit for directly conveying, to the condenser, some of the refrigerant discharged from the compressor.

Preferably, oil separated in the oil separation unit is directly returned to the compressor. Alternatively, the oil could be returned to the compressor through an accumulator disposed at the inlet side of the compressor.

According to the present invention, some of the refrigerant exhausted from the compressor flows through the oil separation unit, and the rest of the exhausted refrigerant is directly supplied into the condenser by way of the bypass pipe. The performance of the air conditioner does not suffer, because the compressor receives oil. However, there is less flow resistance in the oil separation unit due to the presence of the bypass pipe. As a result, the amount of consumed energy is substantially reduced, and the efficiency of air conditioner is maximized.

BRIEF DESCRIPTION OF THE DRAWINGS

The above object and advantages will be more apparent by describing preferred embodiment in greater detail with reference to the drawings accompanied, in which.

DETAILED DESCRIPTION OF THE PREFERRED EMBODIMENT

Hereinafter, a preferred embodiment of the present invention will be described in greater detail with reference to FIG. 1 which schematically shows the construction of an air conditioner according to the present invention.

Figure 1:
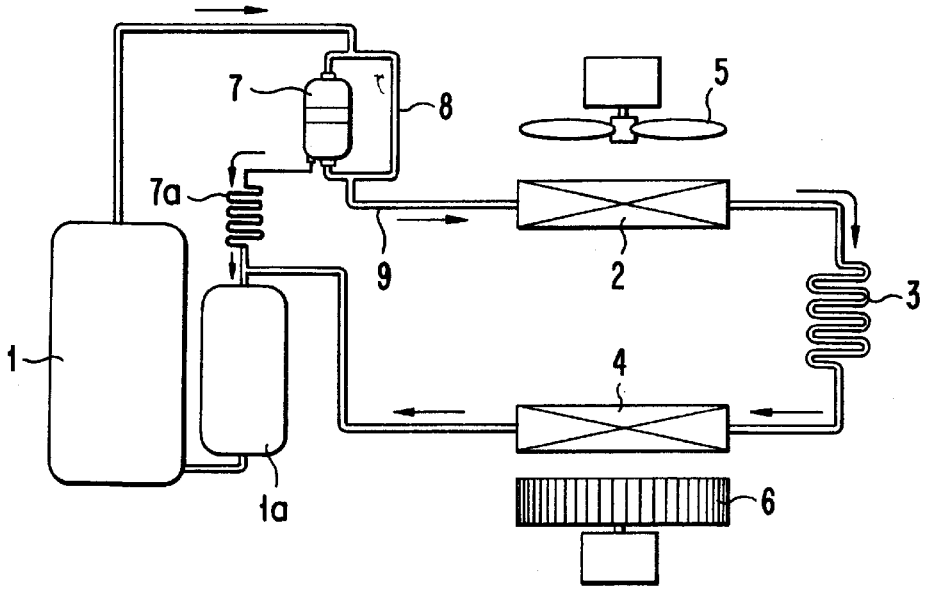
FIG. 1 is a diagram schematically showing an air conditioner according to the present invention.

As shown in FIG. 1, the air conditioner includes a compressor 1, a condenser 2, a capillary tube 3, an evaporator 4, an oil separation unit 7, and a bypass pipe 8.

Compressor 1 compresses the refrigerant introduced from evaporator 4 into high temperature and high pressure refrigerant. Condenser 2 liquefies the compressed refrigerant into a normal temperature and high pressure liquid. The refrigerant introduced from condenser 2 passes through capillary tube 3, losing its pressure and assuming a low pressure which facilitates evaporation. So, when the low pressure refrigerant passes through evaporator 4, it is evaporated while absorbing surrounding heat. The evaporated refrigerant is again compressed in compressor 1 into a high temperature and high pressure gas.

Meanwhile, bypass pipe 8 is disposed between compressor 1 and condenser 2 and enables refrigerant to bypass an oil separation unit 7.

The oil separation unit 7 is installed at the middle portion of a refrigerant conveying pipe 9 downstream of the compressor and communicates with an accumulator 1*a* installed at an inlet side of compressor 1, through an oil returning pipe 7*a*. The main aspect of the present invention, i.e., the bypass pipe 8, is installed in parallel with the oil separation unit 7 for allowing refrigerant to be conveyed directly into condenser 2 without passing through oil separation unit 7.

In the above described construction, the refrigerant compressed in compressor 1 is exhausted from compressor 1 in a condition that it contains some oil. Part of the exhausted refrigerant is supplied into oil separation unit 7, and the remainder is supplied directly into condenser 2 through bypass pipe 8.

Oil separated from refrigerant in the oil separation unit 7 is returned to compressor 1 through oil returning pipe 7*a* and accumulator 1*a*. And refrigerant is supplied to condenser 2 through refrigerant conveying pipe 9. While the presently discussed embodiment shows oil returning pipe 7*a* connected with accumulator 1*a,* it could instead be directly connected with the inlet side of compressor 1.

Figure 2:
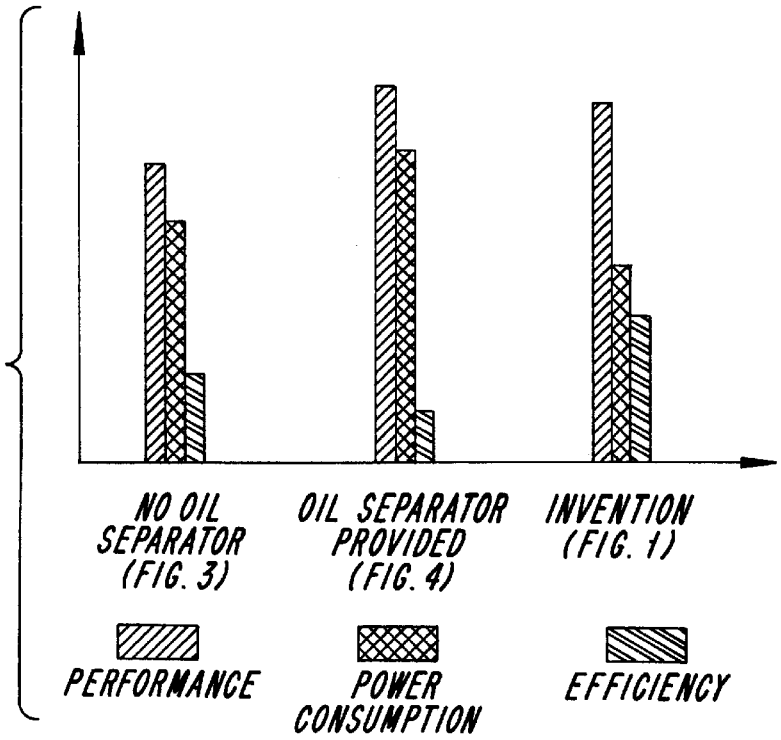
FIG. 2 is a graph analyzing differences in performance, power dissipation, and efficiency between an air conditioner according to the present invention and two prior art arrangements.
Figure 3:
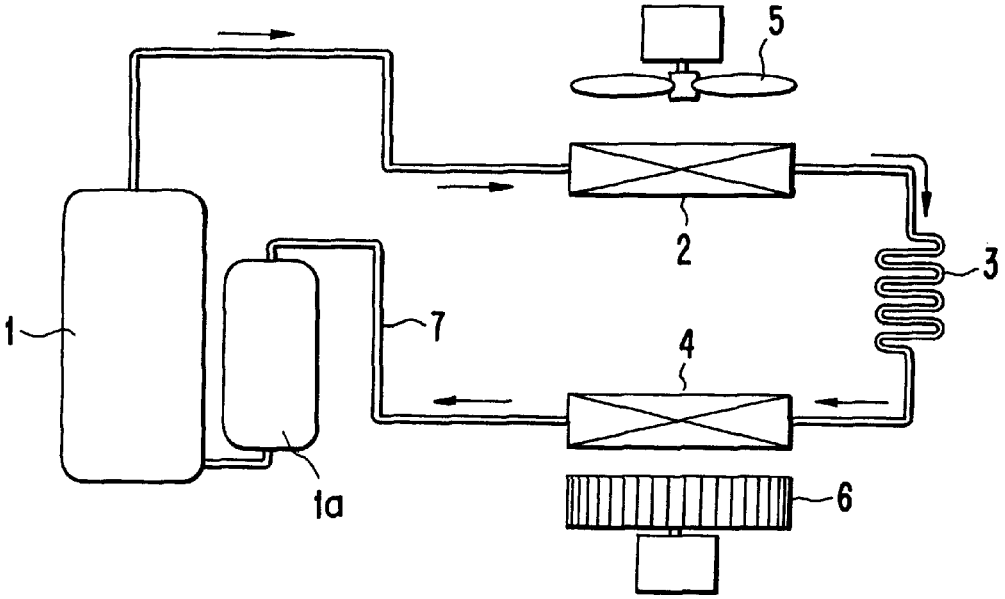
FIG. 3 (PRIOR ART)
FIG. 3 is a diagram schematically showing a conventional air conditioner.
Figure 4:
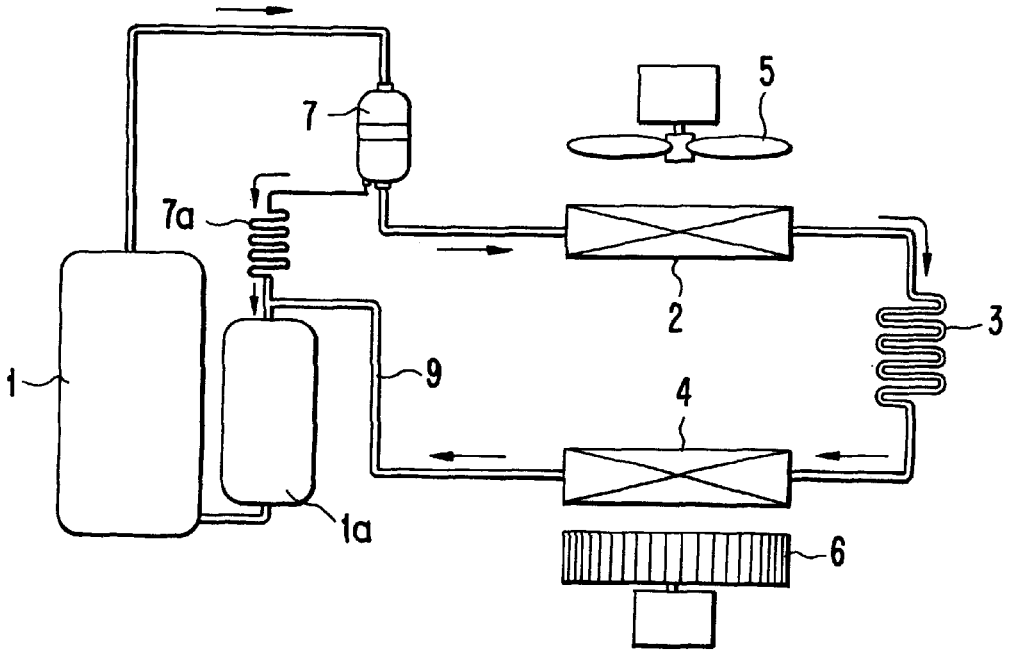
FIG. 4 (PRIOR ART)
FIG. 4 is a diagram schematically showing another conventional air conditioner.

According to the present invention, since some of the exhausted refrigerant from compressor 1 is directly supplied into condenser 2 without passing through oil separation unit 7, the flow resistance occurring in oil separation unit 7 is substantially reduced. Accordingly, as shown in FIG. 2, the air conditioner consumes less energy than an air conditioner having no bypass 8.

In addition, according to the present invention, it turns out that the performance of the air conditioner is almost never affected by oil contained in the refrigerant, when it is supplied to condenser 2 through bypass pipe 8. That is, there is almost no difference in the performance of the air conditioner of FIG. 1 as compared with the prior art, which has only oil separation unit 7. Since the air conditioner according to the present invention consumes less energy, it is more efficient.

As described above, the present invention provides an advantage of substantially reduced flow resistance in the oil separation unit due to the presence of the bypass pipe. Accordingly, energy consumption is significantly reduced without causing deteriorated performance, thereby maximizing efficiency.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An air conditioner comprising:

a compressor for compressing a refrigerant into a high temperature and high pressure gaseous refrigerant;

a condenser for condensing the compressed gaseous refrigerant into a lower temperature and high pressure liquid refrigerant;

a pressure-lowering device for lowering the pressure of the refrigerant introduced from said condenser;

an evaporator for evaporating the refrigerant passed through said pressure-lowering device to cool ambient air;

an oil separation unit disposed between said compressor and said condenser, for separating oil contained in refrigerant discharged from said compressor; and a bypass pipe disposed in parallel with said oil separation unit, for directly conveying, to said condenser, some of the refrigerant discharged from said compressor.

2. The air conditioner as claimed in claim 1, wherein oil separated from said oil separation unit is directly returned to said compressor.

3. The air conditioner as claimed in claim 1, further including an oil return line for returning separated oil from said oil separation unit to a location upstream of said compressor.

4. The air conditioner as claimed in claim 3, further including an accumulator disposed between said evaporator and said compressor, said oil return line supplying oil to said accumulator.

* * * * *